United States Patent [19]

Frazier et al.

[11] Patent Number: 4,932,615

[45] Date of Patent: Jun. 12, 1990

[54] RAILROAD TRACK SIMULATOR FOR ASSESSING TRACK SIGNAL SUSCEPTIBILITY TO ELECTRIC POWER LINE INTERFERENCE

[75] Inventors: Marvin J. Frazier, Roselle, Ill.; Donald R. Little, Greensburg, Pa.

[73] Assignee: Electric Power Research Institute, Palo Alto, Calif.

[21] Appl. No.: 256,894

[22] Filed: Oct. 12, 1988

[51] Int. Cl.[5] ..... G08B 29/00; B61L 21/00

[52] U.S. Cl. ..... 246/121; 246/20; 246/28 F; 324/225; 324/527; 340/515; 333/23

[58] Field of Search ..... 246/28 F, 28 C, 121, 246/1 C, 20, 50, 473, 1 R, 24, 29 R, 30; 340/514, 515, 870.16, 870.39; 324/217, 224, 533, 527; 333/23, 172

[56] References Cited

U.S. PATENT DOCUMENTS

| | | | |
|---|---|---|---|
| 2,900,628 | 8/1959 | Fegely et al. | 246/28 F |
| 3,205,352 | 9/1965 | Prucher | 246/28 F |
| 3,517,306 | 6/1970 | Anderson et al. | 324/533 |
| 3,710,240 | 1/1973 | Kuehnemann et al. | 324/533 |
| 3,967,219 | 6/1976 | Dolby | 333/172 |
| 4,614,921 | 9/1986 | Yarman | 333/23 |
| 4,760,356 | 7/1988 | Kempster | 333/172 |

FOREIGN PATENT DOCUMENTS

| | | | |
|---|---|---|---|
| 0667086 | 7/1963 | Canada | 246/28 C |

*Primary Examiner*—Andres Kashnikow
*Assistant Examiner*—Mark T. Le
*Attorney, Agent, or Firm*—Henry K. Woodward

[57] ABSTRACT

A railroad track segment simulator for assessing track signal susceptibility to electric power line interference including a circuit including a series dc resistor, a series inductor, and an inductive network representing characteristic impedance of an electrical R-L transmission line, resistor, inductor, and network being serially connected as a series circuit, a first ballast resistance connected between one end of series circuit and a ground potential, and a second ballast resistance connected between another end of series circuit and a ground potential. The impedance of the segment is expressed as:

$$Z_T(\Omega/kft) = R_{dc} + j7.66 \times 10^{-4} f \mathrm{Ln} \frac{1.5}{r_o} + 5.77 \times 10^{-4} \sqrt{f(1+j)/r_o}$$

where:

f=frequency (hz), $r_o$=effective radius of rail at power line ac frequencies=0.09 m for 132 lb/yd rail, $R_{dc}$=dc resistance per kft of track, j=imaginary number, Ln=impedance per track segment.

A plurality of segments can be serially connected to simulate any length of line. Signals coupled to the rails from electric power lines can be introduced at the ends of the rail so that open circuit voltage at the rail ends is the same for the actual and simulated circuits.

2 Claims, 5 Drawing Sheets

RAILROAD TRACK SIMULATOR FOR ASSESSING TRACK SIGNAL SUSCEPTIBILITY TO ELECTRIC POWER LINE INTERFERENCE

BACKGROUND OF THE INVENTION

This invention relates generally to signal transmission in rails of railroads, and more particularly this invention relates to assessing track signal susceptibility to electric power line interference.

Various track signalling systems are in use today on United States railroads including the following:

1. Conventional steady energy d.c. relay track circuits.
2. Coded d.c. track circuits.
3. A.C./d.c. track circuits (rectifier systems).
4. Steady energy double element track circuits (vane relays).
5. Coded energy double element track circuits (phase selective).
6. Low frequency electronic track circuits.
7. Cab signal systems
8. Highway crossing overlay track circuits.
9. Highway crossing motion detection (and predictor) systems.

Heretofore, a major unknown in the analysis of such systems has been the susceptibility of the signalling systems to noise derived from electric power transmission lines in close parallel operation with the tracks. Prior susceptibility investigations have, met with two principal objections, to wit:

1. The tests lacked a recognition of the "systems design approach" required in developing the signalling systems. This can lead to unrealistic conclusions regarding the potential measures that might be taken to overcome susceptibility problems. As an example, the replacement of a very low impedance d.c. track relay with a higher impedance relay that could not satisfy the signalling system functions.

2. The tests did not consider all the factors impacting the measurement of the signalling system susceptibility. The realistic effect of variations in ballast and proper impedance of the track (as a component in the signalling circuit) must be included.

Thus, a need exists for improved testing methods that will simulate real life conditions. It is recognized that the desired output will be a limited number of definite track circuit and grade crossing signalling systems noise susceptibility limits. In reality, of course, there are a very large number of noise limits determined by a host of factors, including (among others):

the type of track circuit under consideration (d.c. relay, electronic, etc.), the function being performed (train detection, broken rail detection, broken down joint detection), ballast conditions, length of track circuit, state of the circuit (occupied or unoccupied), shunting sensitivity requirements, impact of overlay circuits, nature of the noise, single rail versus double rail circuits, end-fed versus center-fed circuits.

SUMMARY OF THE INVENTION

An object of the present invention is an improved method of testing the susceptibility of railroad signalling systems to the types of noise emitted by electric power transmission lines.

A feature of the invention is a simulation circuit for simulating track electrical characteristics.

Briefly, a track interference simulator is provided for testing the susceptibility of track signalling equipment to steady state signals that are induced by nearby electric power transmission lines. The simulator is designed to provide a good simulation to the electrical characteristics of the track that are important to the signal system operation, to provide a good simulation to the electrical characteristics of the track that are important to the development of interference signal voltages at the signalling equipment devices, and to provide a means for relating the interference signal at the track signalling device to the interference signal in the electric power transmission line. These characteristics are maintained for important system operational conditions, such as unoccupied track, occupied track, and broken rail.

Because the d.c. relay signalling systems represent well over half of the railroad track circuit signalling systems in use today, this system is given prime consideration in the simulator. Limiting consideration to this class of signalling device permits simplifications in the simulator configuration and performance requirements, including the simulation of only the differential or rail-to-rail characteristics, and a less restrictive requirement on the frequency range for which the simulator must provide a good approximation to actual track. These considerations permit a simulator design that can be used to test an important class of track signalling circuit, without imposing complications that may be necessary for adequate testing of more sophisticated signalling systems, such as electronic track circuits.

The invention and objects and features thereof will be more readily apparent from the following description and appended claims when taken with the drawings.

DETAILED DESCRIPTION OF ILLUSTRATIVE EMBODIMENT

Figure 1:
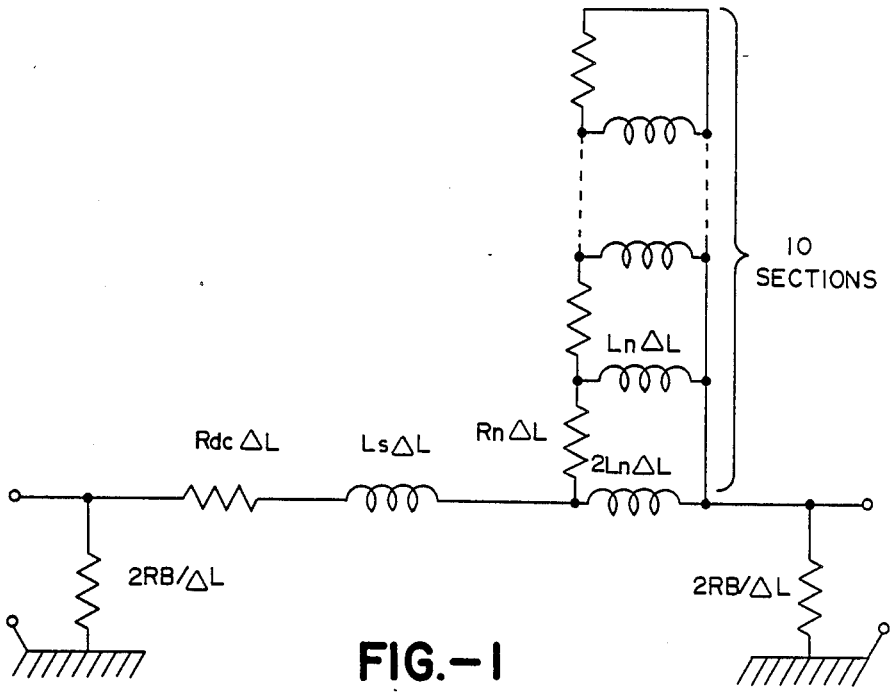
FIG. 1 is a model of an incremental segment of track in accordance with the embodiment of the invention.

FIG. 1 is a schematic representation of an incremental segment of track, as a $\pi$-shaped network of simulated length, $\Delta l$ (kft), including the effect of ballast resistivity, $R_B$ (ohm-kft). A block length of simulated track is comprised of one or more sections of simulated track, such as FIG. 1.

Figure 2:
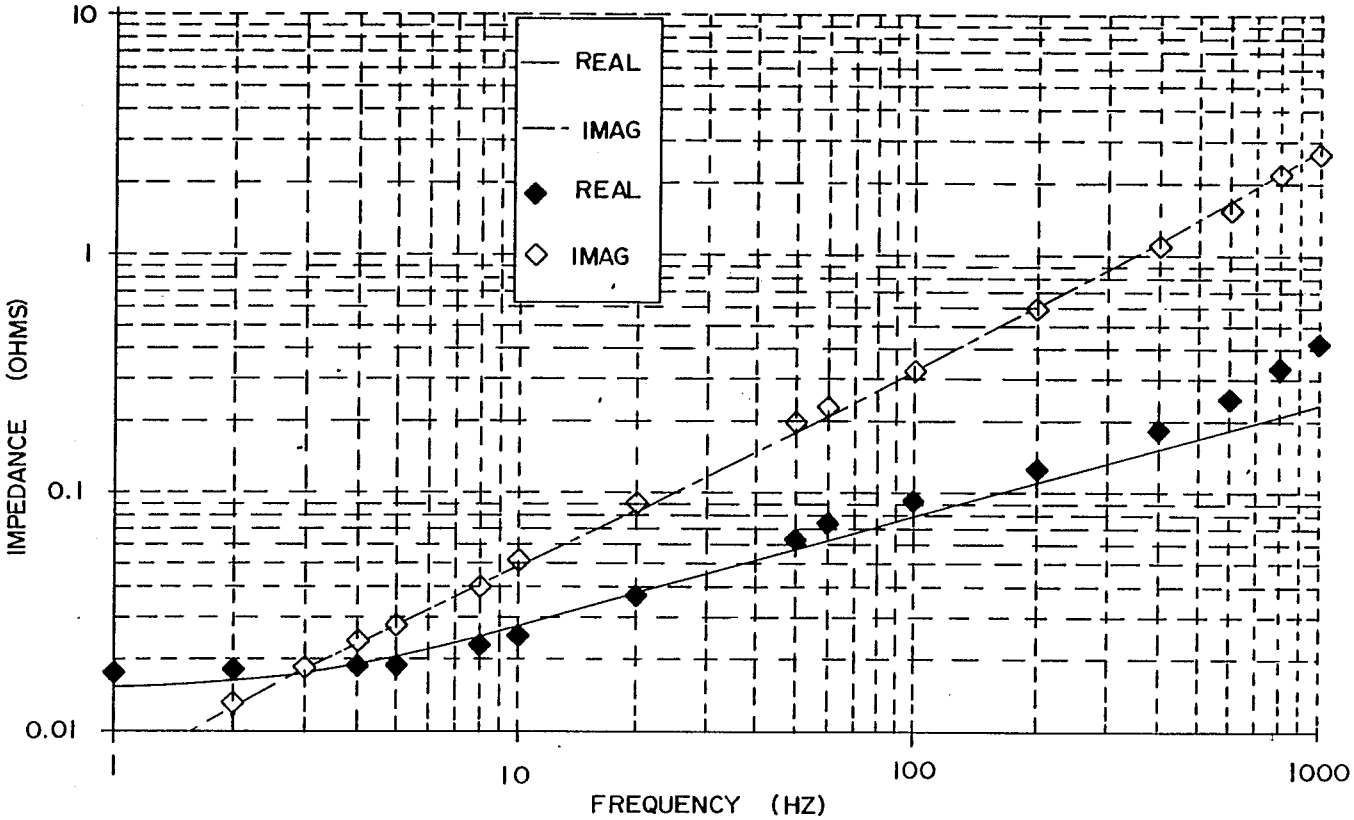
FIG. 2 is a plot of track impedance (per kft) and a comparison of simulator measured values with a curve of accepted values.

The series track impedance per kft length is the input impedance of one or more cascade segments of the FIG. 1 simulation, with the far end shorted and nearly infinite ballast resistivity. FIG. 2 presents the measured track impedance for the simulator, normalized to a per kft basis, shown as the discrete points, compared to an accepted curve of track impedance versus frequency. It is seen from FIG. 2 that the circuit provides a good simulation to the impedance of track over a range of frequency extending from dc to about 1 kHz.

In developing the model of FIG. 1, the approach that was taken incorporated the following steps:

Identify an approximate analytical expression for the per unit length track impedance.

Identify an electrical circuit with an impedance function that approximates the above analytical expression.

Analyze the circuit and adjust key design parameters to obtain reasonable agreement with available accepted track impedance characteristics An approximate expression for the series impedance (per kft) of track is:

$$Z_T(\Omega/kft) = R_{dc} + j7.66 \times 10^{-4} f \mathrm{Ln} \frac{1.5}{r_o} + 5.77 \times 10^{-4} \sqrt{f(1+j)/r_o}$$

where:

f=frequency (Hz), $r_o$=effective radius of rail at power line ac frequencies=0.09 m for 132 lb/yd rail, $R_{dc}$=dc resistance per kft of track, j=imaginary number, Ln=impedance per track segment.

This expression appears to be a good approximation, with the exception of a small range of frequencies above dc and below a few Hz. Thus, it is a good starting point for design. The first term dominates as the frequency goes to zero; the second term is an inductive reactance that dominates as the frequency goes high; and the third term is a transition term, due to skin effect conduction in the rail. The first and second terms relate to simple circuit elements, but the third term requires a more complex network.

The third term is of the form of the characteristic impedance of an electrical R-L transmission line. The characteristic impedance of an electrical transmission line can be approximated by a finite ladder network. The ladder network approximation to the transmission line characteristic impedance improves as the number of sections in the ladder network increases. That is, the ladder starts to look like an infinitely long transmission line. The finite ladder network approximation tends to be a "good" approximation to the transmission line characteristic impedance between a minimum and maximum range of frequencies. The ratio $f_{max}/f_{min}$ is proportional to the number of ladder network sections squared. The ratio, as well as the specific values of $f_{max}$ and $f_{min}$ are design parameters that were adjusted to obtain a good agreement between the simulator circuit impedance and the track impedance. The simulator design selected is based on a 10 section ladder network to approximate the third term of Equation 1 over the frequency range between about 15 and 950 Hz.

The electrical simulation of a block length of track employs the cascading of a number of elemental track segment sections like that shown in FIG. 1. The smaller the equivalent length of each elemental track segment, the larger will be the number of segments necessary to simulate a given length of track. The more segments that are used to simulate a given length of track, the larger is the bandwidth over which the simulation is a good approximation to the actual track. The simulator according to one embodiment approximates a one mile track block. Two one-half mile segments, such as FIG. 1, are used to simulate the one mile length of track. The inductors of the circuit of FIG. 1 are wound with AWG 6 or 8 wire on large ferrite E-cores. Amplifiers can be used to supply the interference signal to the network. An interference signal source and metering to monitor the performance of the network and the relay under test are provided with the model.

The use of only two segments, such as is shown in FIG. 1, to simulate a one mile track block limits the frequency range of good simulation under conditions of low ballast resistivity. Two characteristics of the track can be used to assess the frequency range of good simulation. The characteristics are the input impedance and the end-to-end voltage transfer function for the one mile block length, with the far end open circuited.

Figure 3:
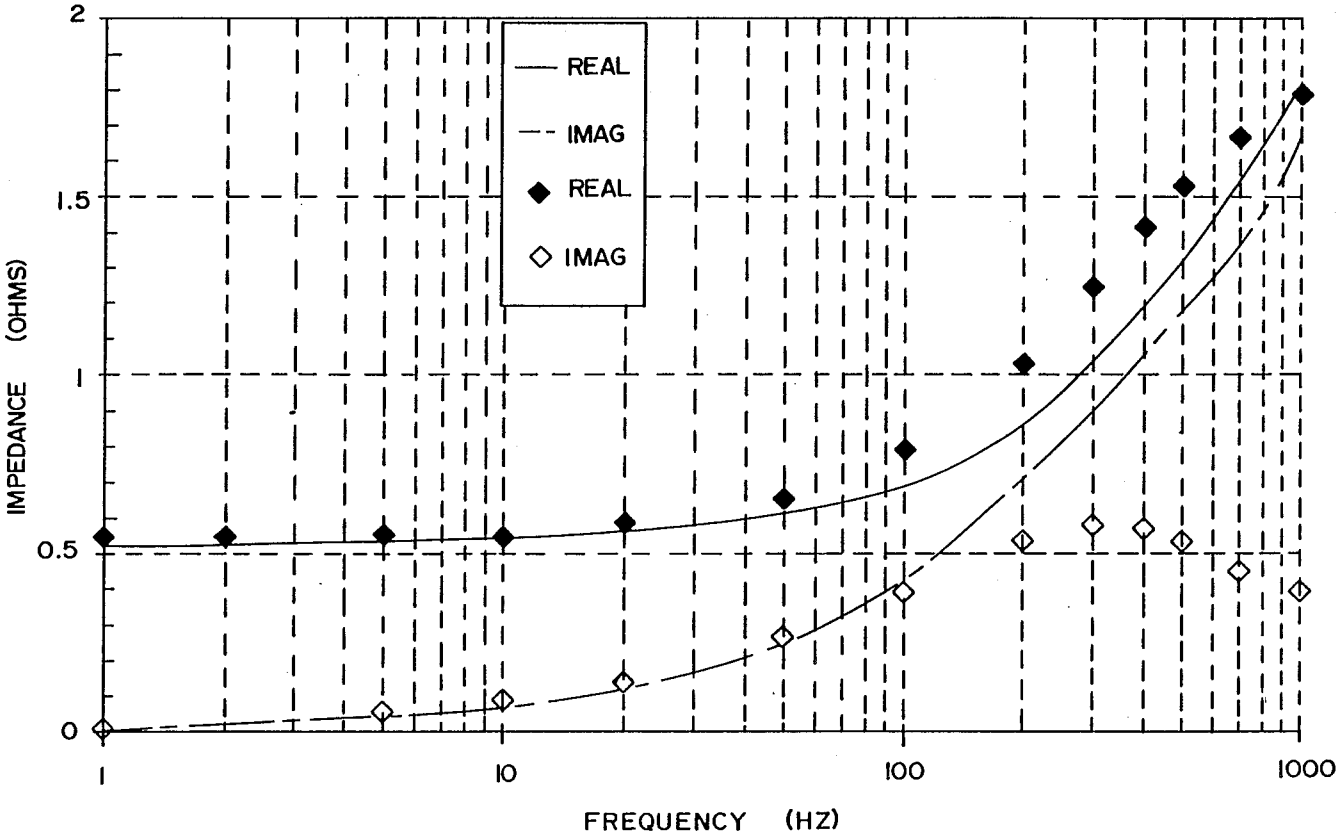
FIG. 3 is a plot of input impedance for a non-terminated one mile block with 2.6 ohm-kft ballast using simulator date and theoretical data.
Figure 4:
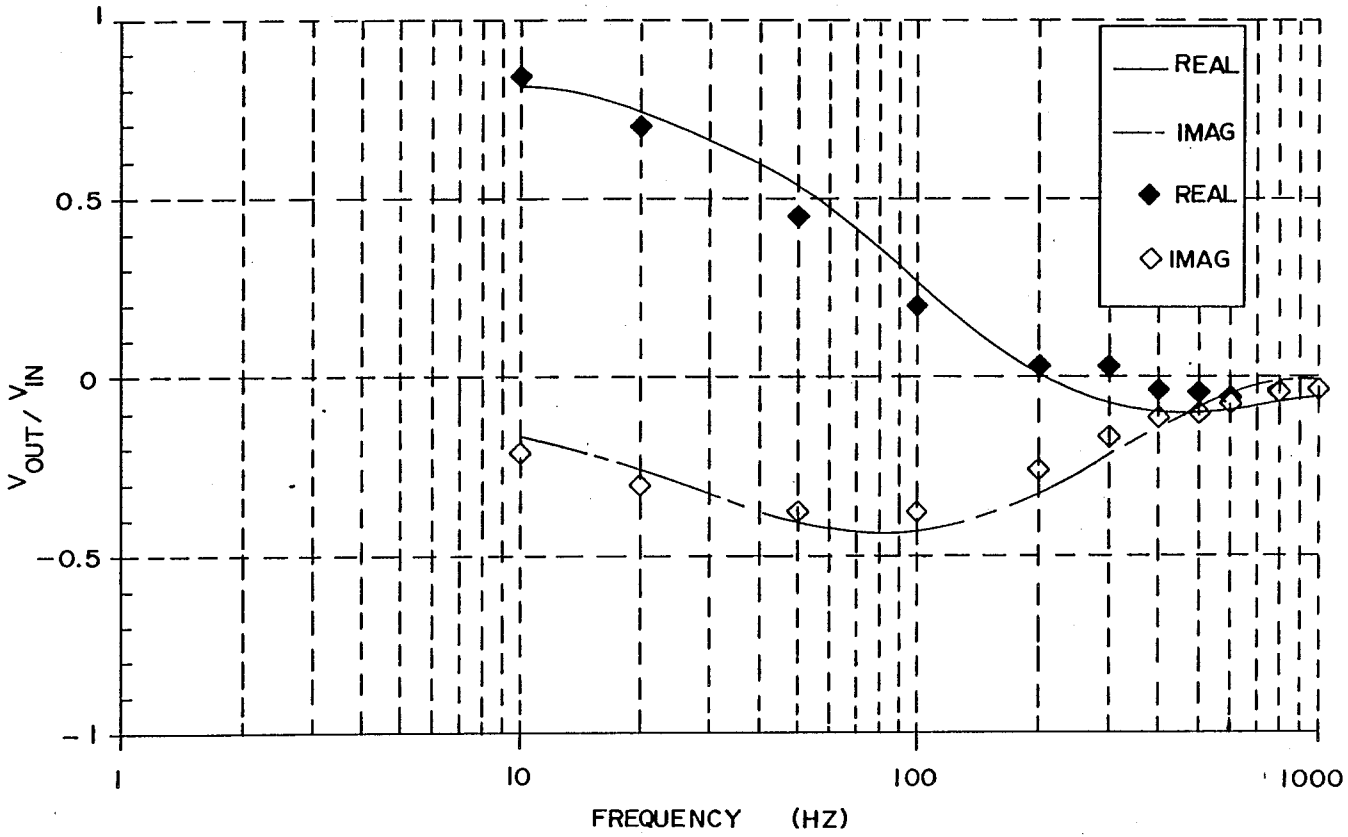
FIG. 4 is a plot of output to input voltage transfer function for a non-terminated one mile block with 2.6 ohm-kft ballast using simulator data and theoretical data.

FIG. 3 shows measured data points of input impedance for the simulator, as compared to predicted curves for an ideal distributed track model, both for a 2.6 ohm-kft ballast. FIG. 4 shows measured values for the voltage transfer function (real and imaginary parts of $V_{out}/V_{in}$) for the simulator, compared to predicted curves for an ideal distributed track. It can be seen from FIGS. 3 and 4 that, for the low ballast conditions, the simulator provides a good comparison to the ideal characteristics for frequencies below about a few hundred $H_z$. The frequency range of good simulation can be increased by using more segments to simulate the one mile block length. However, it is felt that the use of half mile segments is adequate for testing dc relays and some other low frequency track circuits and serves to demonstrate the simulator design concept.

Signals due to current flow in an electric power transmission line are coupled into the rails all along the exposure. However, for testing with an electrically-simulated track circuit, a more convenient approach is to introduce the noise signal at the ends of the rail, so that the open circuit voltage at the rail ends is the same for the actual and simulated circuits. If both the open circuit noise voltage and the impedance looking into rails at each end are the same for the actual rails and for the simulation circuit, then the voltage and current at any signal equipment attached to the rail ends will be the same for the two cases. The relationship between the currents in the power transmission line and the voltage at the rail ends can be determined by analytical means.

The test process employed to determine the influence of power line noise on d.c. relay track circuit systems concentrates on the possible disruption of the vital functions of train detection and broken rail detection. Although broken down joint detection is also an important function provided by such systems, analysis indicates that, for the same length of track, broken rail detection is more stressed by noise than is joint detection.

Figure 5:
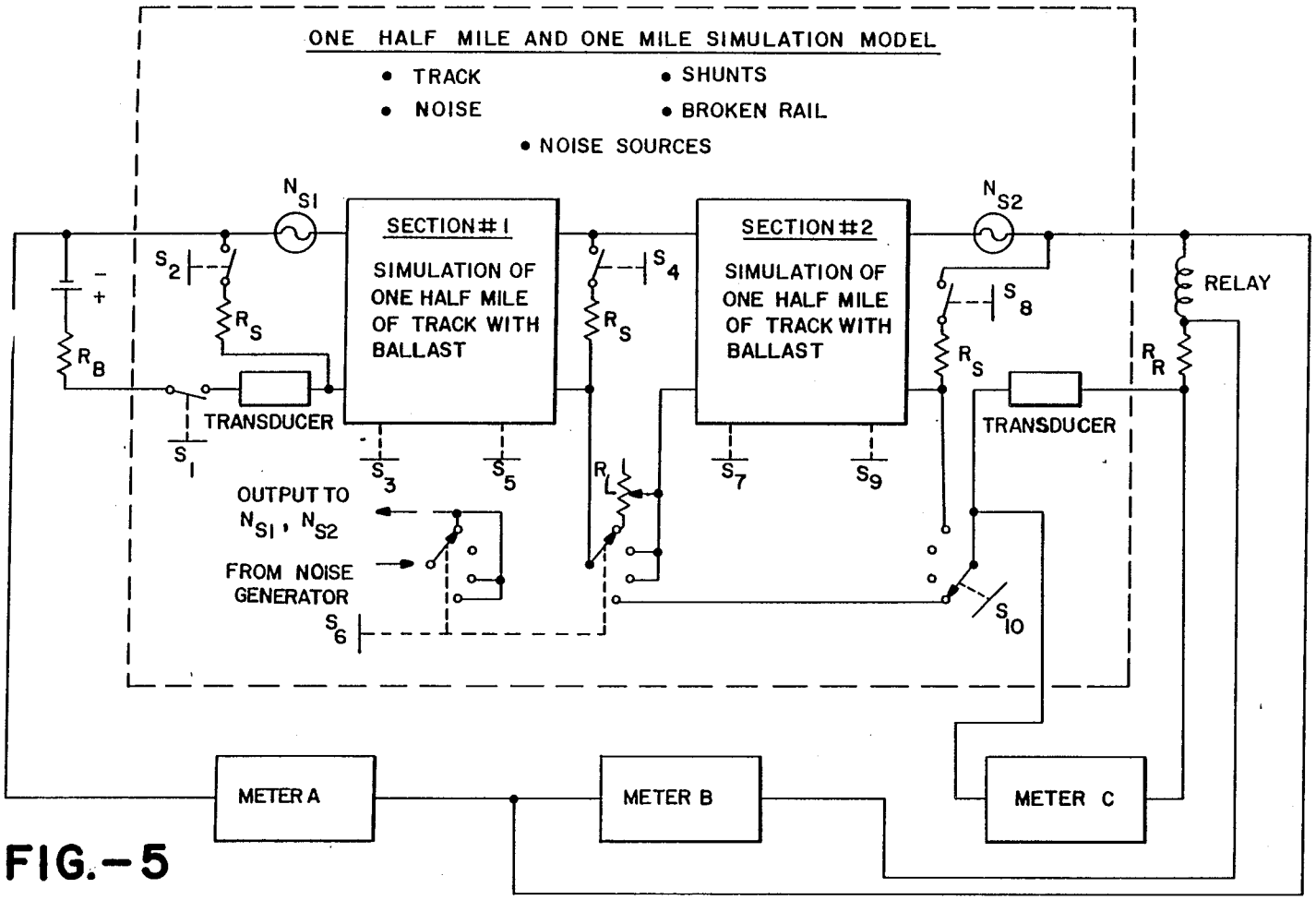
FIG. 5 is a schematic of a D.C. relay track circuit system test configuration.

The d.c. relay track circuit system simulator test configuration is shown in FIG. 5. The test configuration incorporates two half mile rail segment simulations with lumped noise sources ($N_{S1}$ and $N_{S2}$). For the half mile test procedure, switches $S_6$ and $S_{10}$ are employed to bypass section #2, allowing the testing with section #1 alone. For the testing of one mile systems, both section #1 and section #2 are employed.

As indicated in FIG. 5, the setup provides the means to simulate the track, noise, shunts, and broken rail. The system elements employed with their functions are briefly described as follows:

$R_B$ and $R_R$ are current limiting resistors at the battery and relay ends, respectively.

Switch $S_1$ provides the means for interrupting the d.c. battery current and simulates a rail break at the battery end of section #1.

Switches $S_2$, $S_4$ and $S_8$ control 0.06 ohm shunts at the battery end, the half mile point and the relay end, respectively.

Switches $S_3$, $S_5$, $S_7$ and $S_9$ control the setting of the ballast resistance for the simulator. Available ballast settings include 2.6, 4.4, 6.6, 13.2 and 132 ohm-kft of track.

Switch $S_6$ provides (1) selection of the half or one mile configuration (with switch $S_{10}$), (2) simulation of a rail break in the middle of the one mile track circuit, including the ballast leakage around the break, and (3) control of the application and removal of noise source for rail break simulation.

Meters A, B and C are true rms digital meters to measure the total noise voltage of (NS1+NS2), the noise voltage across the relay, and the d.c. or noise current through the relay, respectively.

Figure 6:
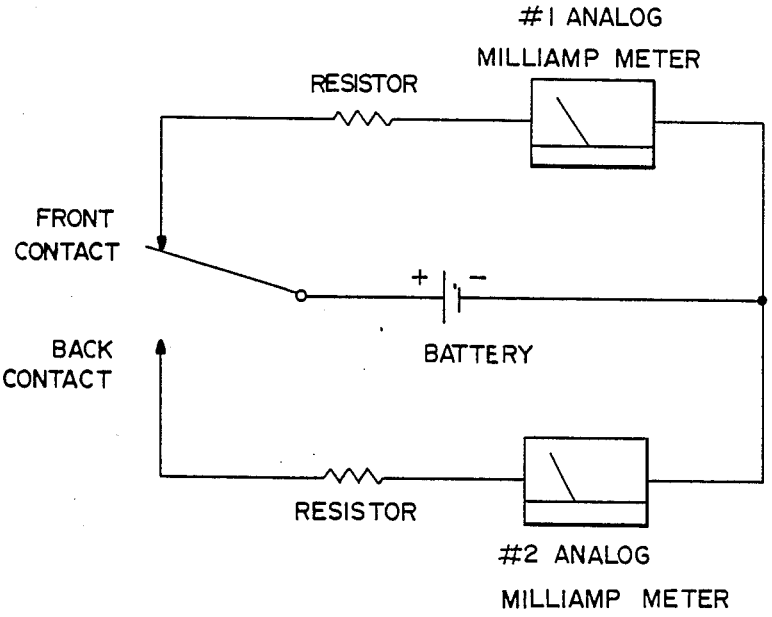
FIG. 6 is a schematic of a relay contact detection circuit.

Since the final critical indication of the "status" of a d.c. relay track circuit (occupied, unoccupied, broken rail) is defined by the "state" of its contacts, the criteria for detecting the disruption of normal system operation by power system noise focuses on the condition of the relay contacts. For normal, unperturbed operation, the contacts should indicate the instantaneous status of the track circuit by the continuous "total making" of the appropriate contacts (except, obviously, during occupied/unoccupied transitions). For the purposes of this test procedure, any deviation from the normal total continuous opening or closing of the contacts in the appropriate manner was viewed as an operational disruption. The tests focus on determining the noise levels that exceeds the threshold of continuous total closure or opening of the appropriate contacts. The relay contact circuit shown in FIG. 6 is used to determine this "threshold" of noise disruption. The determination of when a system failure occurs is left to the judgment of the system designer.

There has been described a railroad track simulator and test procedure for assessing track signal susceptibility to electric power line interference. While the invention has been described with reference to a specific embodiment, the description is illustrative of the invention and is not to be construed as limiting the invention. Various modifications and applications may occur to those skilled in the art without departing from the true spirit and scope of the invention as defined by the appended claims.

We claim:

1. Railroad track segment simulator for assessing track signal susceptibility to electric power line interference, said segment simulator comprising a series dc resistor, a series inductor, and an inductive network representing characteristic impedance of an electrical R-L transmission line, said resistor, said inductor, and said network being serially connected as a series circuit, a first ballast resistance connected between one end of said series circuit and a ground potential, and a second ballast resistance connected between another end of said series circuit and a ground potential.

2. The segment simulator as defined by claim 1 wherein impedance of said segment is expressed as follows:

$$Z_T(\Omega/kft) = R_{dc} + j7.66 \times 10^{-4} f \mathrm{Ln} \frac{1.5}{r_o} + 5.77 \times 10^{-4} \sqrt{f(1+j)/r_o}$$

where:

f=frequency (hz), $r_o$=effective radius of rail at power line ac frequencies=0.09 m for 132 lb/yd rail, $R_{dc}$=dc resistance per kft of track, j=imaginary number, Ln=impedance per track segment.

* * * * *